US011913197B2

(12) United States Patent
Fukuoka

(10) Patent No.: US 11,913,197 B2
(45) Date of Patent: Feb. 27, 2024

(54) SHOVEL AND SYSTEM FOR SHOVEL

(71) Applicant: SUMITOMO CONSTRUCTION MACHINERY CO., LTD., Tokyo (JP)

(72) Inventor: Toshiki Fukuoka, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 225 days.

(21) Appl. No.: 17/448,410

(22) Filed: Sep. 22, 2021

(65) Prior Publication Data

US 2022/0002976 A1 Jan. 6, 2022

Related U.S. Application Data

(63) Continuation of application No. PCT/JP2020/013005, filed on Mar. 24, 2020.

(30) Foreign Application Priority Data

Mar. 26, 2019 (JP) ..... 2019-059334

(51) Int. Cl.

| | |
|---|---|
| ***E02F 9/16*** | (2006.01) |
| ***E02F 9/26*** | (2006.01) |
| *E02F 3/32* | (2006.01) |
| *E02F 9/22* | (2006.01) |

(52) U.S. Cl.

CPC ..... *E02F 9/26* (2013.01); *E02F 9/16* (2013.01); *E02F 3/32* (2013.01); *E02F 9/2232* (2013.01); *E02F 9/2285* (2013.01); *E02F 9/2292* (2013.01); *E02F 9/2296* (2013.01)

(58) Field of Classification Search

CPC ..... E02F 9/26; E02F 9/16; E02F 3/32

See application file for complete search history.

(56) References Cited

U.S. PATENT DOCUMENTS

| | | | | |
|---|---|---|---|---|
| 10,391,940 | B2 | 8/2019 | Izumikawa et al. | |
| 2007/0018796 | A1* | 1/2007 | Scheer | B60R 25/24 340/425.5 |
| 2016/0265196 | A1* | 9/2016 | Shimizu | E02F 9/24 |
| 2019/0218753 | A1* | 7/2019 | Morimoto | E02F 9/2883 |
| 2020/0048867 | A1 | 2/2020 | Kimura et al. | |

FOREIGN PATENT DOCUMENTS

| | | | | |
|---|---|---|---|---|
| EP | 3023552 | | 5/2016 | |
| JP | 2004-225566 | | 8/2004 | |
| JP | 2013-050007 | | 3/2013 | |
| JP | 2018-204252 | | 12/2018 | |
| WO | WO 2012140982 | * | 10/2012 | G01D 11/28 |
| WO | 2015/163381 | | 10/2015 | |
| WO | WO 2015159577 | * | 10/2015 | G05B 23/02 |

OTHER PUBLICATIONS

International Search Report for PCT/JP2020/013005 dated Jun. 16, 2020.

* cited by examiner

*Primary Examiner* — Hongmin Fan
(74) *Attorney, Agent, or Firm* — IPUSA, PLLC

(57) ABSTRACT

A shovel includes a lower traveling structure, an upper swing structure swingably mounted on the lower traveling structure, a cab mounted on the upper swing structure, a door provided on the cab, a display placed in the cab, a switch placed at a position near the door and distant from the display, and processing circuitry configured to output information stored in the shovel in response to the switching of the switch.

20 Claims, 7 Drawing Sheets

SHOVEL AND SYSTEM FOR SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/013005, filed on Mar. 24, 2020 and designating the U.S., which claims priority to Japanese Patent Application No. 2019-059334, filed on Mar. 26, 2019. The entire contents of the foregoing applications are incorporated herein by reference.

BACKGROUND

Technical Field

The present disclosure relates to shovels and systems for shovels.

Description of Related Art

A shovel with a display unit that displays the cumulative operating time of an engine has been known. This shovel is configured to be able to display the cumulative operating time of the engine along with the control status, the fuel consumption state, the coolant water temperature, the remaining amount of fuel of the engine, etc., on the display unit.

SUMMARY

According to an aspect of the present invention, a shovel includes a lower traveling structure, an upper swing structure swingably mounted on the lower traveling structure, a cab mounted on the upper swing structure, a door provided on the cab, a display placed in the cab, a switch placed at a position near the door and distant from the display, and processing circuitry configured to output information stored in the shovel in response to the switching of the switch.

DETAILED DESCRIPTION

The related-art shovel is configured such that various kinds of information are easily viewable by a shovel operator seated in an operator seat, but is not configured to enable a maintenance worker, a repair worker, a manager or the like (hereinafter "maintenance worker or the like") who does not sit in the operator seat and works outside a cab to view desired information with ease. Therefore, the maintenance worker or the like has to ride in the cab and operate the display unit to visually recognize desired information stored in a storage installed in the shovel. It is not efficient to ride in the cab and operate the display unit from shovel to shovel in order to view information stored in the storage installed in each of multiple shovels.

Therefore, it is desired to enable a maintenance worker or the like to more easily check information stored in a storage installed in a shovel.

According to an aspect of the present invention, a shovel that enables a maintenance worker or the like to more easily check information stored in a storage installed in the shovel is provided.

Figure 1:
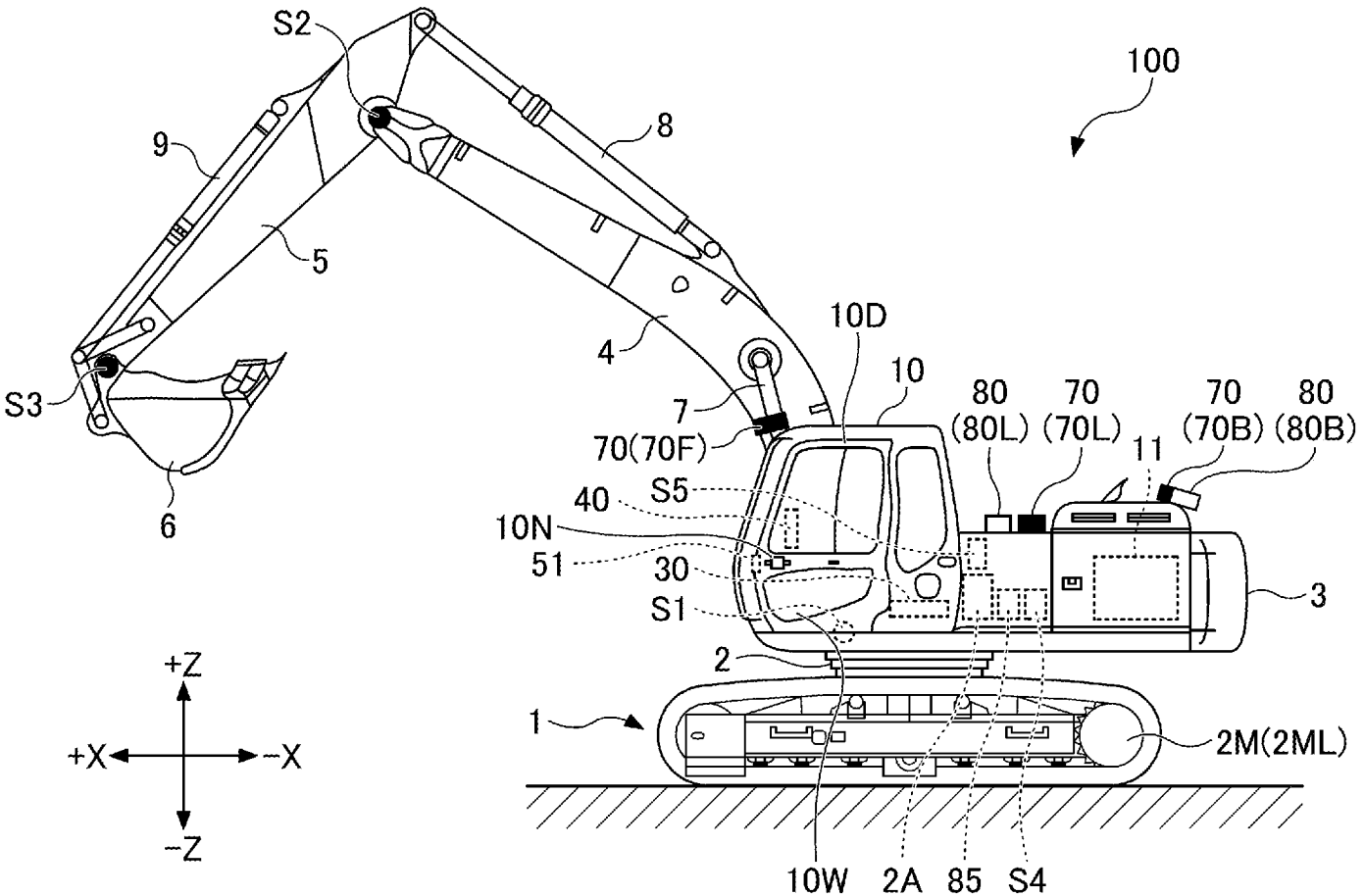
FIG. 1 is a side view of a shovel according to an embodiment of the present invention.
Figure 2:
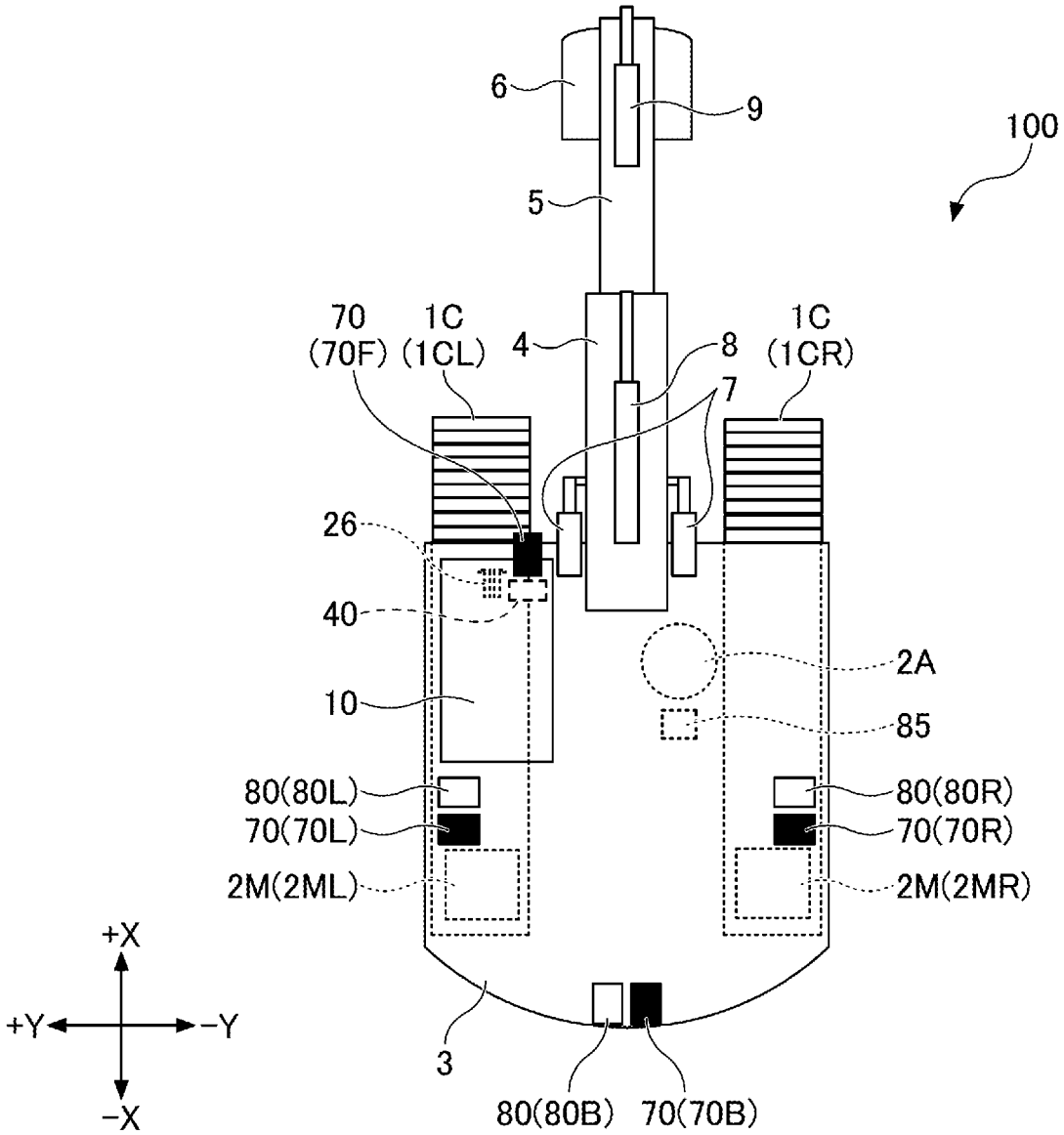
FIG. 2 is a plan view of the shovel of FIG. 1.

First, a shovel 100 serving as an excavator according to an embodiment of the present invention is described with reference to FIGS. 1 and 2. FIG. 1 is a side view of the shovel 100. FIG. 2 is a plan view of the shovel 100.

According to this embodiment, a lower traveling structure 1 of the shovel 100 includes crawlers 1C as illustrated in FIG. 2. The crawlers 1C are driven by travel hydraulic motors 2M mounted on the lower traveling structure 1. Travel motor generators serving as electric actuators may be an alternative to the travel hydraulic motors 2M. Specifically, the crawlers 1C include a left crawler 1CL and a right crawler 1CR. The left crawler 1CL is driven by a left travel hydraulic motor 2ML. The right crawler 1CR is driven by a right travel hydraulic motor 2MR.

An upper swing structure 3 is swingably mounted on the lower traveling structure 1 via a swing mechanism 2. The swing mechanism 2 is driven by a swing hydraulic motor 2A mounted on the upper swing structure 3. A swing motor generator serving as an electric actuator may be an alternative to the swing hydraulic motor 2A.

A boom 4 is attached to the upper swing structure 3. An arm 5 is attached to the distal end of the boom 4. A bucket 6 is attached to the distal end of the arm 5. The boom 4, the arm 5, and the bucket 6 constitute an excavation attachment that is an example of an attachment. The boom 4 is driven by a boom cylinder 7. The arm 5 is driven by an arm cylinder 8. The bucket 6 is driven by a bucket cylinder 9.

A boom angle sensor S1 is attached to the boom 4. An arm angle sensor S2 is attached to the arm 5. A bucket angle sensor S3 is attached to the bucket 6.

The boom angle sensor S1 detects the pivot angle of the boom 4. According to this embodiment, the boom angle sensor S1 is an acceleration sensor, and can detect a boom angle that is the pivot angle of the boom 4 relative to the upper swing structure 3. For example, the boom angle is minimized when the boom 4 is lowest, and increases as the boom 4 rises.

The arm angle sensor S2 detects the pivot angle of the arm 5. According to this embodiment, the arm angle sensor S2 is an acceleration sensor, and can detect an arm angle that is the pivot angle of the arm 5 relative to the boom 4. For example, the arm angle is minimized when the arm 5 is most closed, and increases as the arm 5 opens.

The bucket angle sensor S3 detects the pivot angle of the bucket 6. According to this embodiment, the bucket angle sensor S3 is an acceleration sensor, and can detect a bucket angle that is the pivot angle of the bucket 6 relative to the arm 5. For example, the bucket angle is minimized when the bucket 6 is most closed, and increases as the bucket 6 opens.

Each of the boom angle sensor S1, the arm angle sensor S2, and the bucket angle sensor S3 may be a potentiometer using a variable resistor, a stroke sensor that detects the stroke amount of a corresponding hydraulic cylinder, a rotary encoder that detects a pivot angle about a link pin, a gyroscope, a combination of an acceleration sensor and a gyroscope, or the like.

A cabin 10 serving as a cab is provided and a power source such as an engine 11 is mounted on the upper swing structure 3. Furthermore, a controller 30, an object detector 70, an image capturing device 80, an orientation detector 85, a machine body tilt sensor S4, a swing angular velocity sensor S5, etc., are attached to the upper swing structure 3. An operating device 26, a display unit 40, etc., are provided in the cabin 10. In this specification, for convenience, the side of the upper swing structure 3 on which the boom 4 is attached (the +X side) is defined as the front side, and the side of the upper swing structure 3 on which a counterweight is attached (the −X side) is defined as the back side.

The controller 30 is a control device (an example of processing circuitry) configured to control the shovel 100. According to this embodiment, the controller 30 is constituted of a computer including a CPU, a volatile storage, a nonvolatile storage, etc. The controller 30 reads programs corresponding to functions from the nonvolatile storage, loads the programs into the volatile storage, and causes the CPU to execute corresponding processes.

The display unit 40 is configured to display various kinds of information. According to this embodiment, the display unit 40 is installed on the front right inside the cabin 10, and is configured to display information on at least one of a work condition and an operating state of the shovel 100. An operator seated in an operator seat can perform work with the shovel 100 while checking various kinds of information displayed on the display unit 40. The display unit 40 may include one or more switches that are used to control an image displayed on the display unit 40.

The object detector 70 is configured to detect an object present in an area surrounding the shovel 100. The object detector 70 may also be configured to calculate a distance between the object detector 70 or the shovel 100 and a recognized object. Examples of objects include a person, an animal, a vehicle, a construction machine, a building, and a hole. Examples of the object detector 70 include an ultrasonic sensor, a millimeter wave radar, a stereo camera, a LIDAR, a distance image sensor, and an infrared sensor. According to this embodiment, the object detector 70 includes a front sensor 70F attached to the front end of the upper surface of the cabin 10, a back sensor 70B attached to the back end of the upper surface of the upper swing structure 3, a left sensor 70L attached to the left end of the upper surface of the upper swing structure 3, and a right sensor 70R attached to the right end of the upper surface of the upper swing structure 3.

The object detector 70 may also be configured to detect a predetermined object within a predetermined area set in an area surrounding the shovel 100. For example, the object detector 70 may also be configured to be able to distinguish between a person that is the predetermined object and an object other than a person.

The image capturing device 80 is configured to capture an image of an area surrounding the shovel 100. Examples of the image capturing device 80 include a monocular camera, a stereo camera, a distance image camera, an infrared camera, and a LIDAR. According to this embodiment, the image capturing device 80 includes a back camera 80B attached to the back end of the upper surface of the upper swing structure 3, a left camera 80L attached to the left end of the upper surface of the upper swing structure 3, and a right camera 80R attached to the right end of the upper surface of the upper swing structure 3. The image capturing device 80 may also include a front camera.

The back camera 80B is placed next to the back sensor 70B. The left camera 80L is placed next to the left sensor 70L. The right camera 80R is placed next to the right sensor 70R. The front camera may be placed next to the front sensor 70F.

An image captured by the image capturing device 80 is displayed on the display unit 40 installed in the cabin 10. The image capturing device 80 may be configured to be able to display a viewpoint change image such as an overhead view image on the display unit 40. The overhead view image is generated by, for example, combining the respective output images of the back camera 80B, the left camera 80L, and the right camera 80R.

The back camera 80B, the left camera 80L, and the right camera 80R is attached to the upper swing structure 3 such that their respective optical axes point obliquely downward and that their respective imaging ranges include part of the upper swing structure 3. The respective imaging ranges of the back camera 80B, the left camera 80L, and the right camera 80R, for example, have an angle of view of approximately 180 degrees in a plan view.

The image capturing device 80 may also operate as an object detector. In this case, the object detector 70 may be omitted.

The orientation detector 85 is configured to detect information on the relative relationship between the orientation of the upper swing structure 3 and the orientation of the lower traveling structure 1. For example, the orientation detector 85 may be constituted of a combination of a geomagnetic sensor attached to the lower traveling structure 1 and a geomagnetic sensor attached to the upper swing structure 3. The orientation detector 85 may also be constituted of a combination of a GNSS receiver attached to the lower traveling structure 1 and a GNSS receiver attached to the upper swing structure 3. The orientation detector 85 may also be constituted of a resolver.

The machine body tilt sensor S4 is configured to detect the tilt of the shovel 100 relative to a predetermined plane. According to this embodiment, the machine body tilt sensor S4 is an acceleration sensor that detects the tilt angle of the longitudinal axis and the tilt angle of the lateral axis of the upper swing structure 3 relative to a horizontal plane. The machine body tilt sensor S4 may be constituted of a combination of an acceleration sensor and a gyroscope. The longitudinal axis and the lateral axis of the upper swing structure 3, for example, pass through a shovel central point that is a point on the swing axis of the shovel 100, crossing each other at right angles.

The swing angular velocity sensor S5 is configured to detect the swing angular velocity of the upper swing structure 3. According to this embodiment, the swing angular velocity sensor S5 is a gyroscope. The swing angular velocity sensor S5 may also be a resolver, a rotary encoder, or the like. The swing angular velocity sensor S5 may also detect swing speed. The swing speed may be calculated from swing angular velocity.

Figure 3:
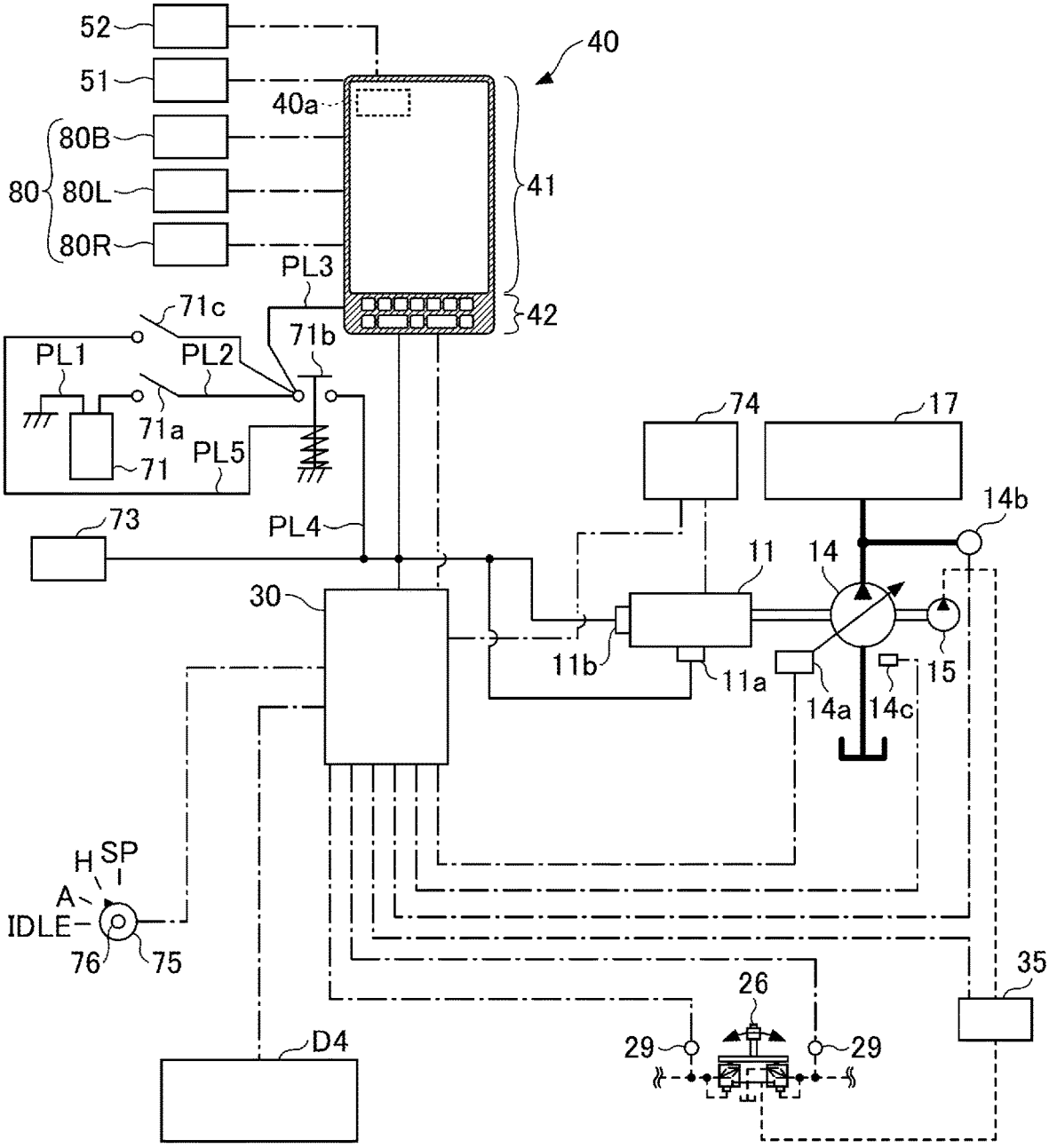
FIG. 3 is a diagram illustrating an example configuration of a basic system installed in the shovel of FIG. 1.

Next, a basic system installed in the shovel 100 is described with reference to FIG. 3. FIG. 3 illustrates an example configuration of the basic system installed in the shovel 100 of FIG. 1. In FIG. 3, a mechanical power transmission line, a hydraulic oil line, a pilot line, a power supply line, and an electrical control line are indicated by a double line, a thick solid line, a dashed line, a thin solid line, and a one-dot chain line, respectively.

As illustrated in FIG. 3, the basic system mainly includes the engine 11, a main pump 14, a pilot pump 15, a control valve unit 17, the operating device 26, an operating pressure sensor 29, the controller 30, a selector valve 35, the display unit 40, an activation switch 51, a room light 52, a main power supply 71, electrical equipment 73, an engine control unit 74, an engine rotational speed adjustment dial 75, and an output characteristic selector switch 76.

The engine 11 is a diesel engine adopting isochronous control that keeps the engine rotational speed constant irrespective of an increase or decrease in a load. The amount of fuel injection, the timing of fuel injection, the boost pressure, etc., in the engine 11 are controlled by the engine control unit 74.

The output shaft of the engine 11 is connected to the respective input shafts of the main pump 14 and the pilot pump 15 serving as hydraulic pumps. The main pump 14 supplies hydraulic oil to the control valve unit 17 via a hydraulic oil line.

The control valve unit 17 is a hydraulic controller that controls the hydraulic system of the shovel 100. The control valve unit 17 is connected to hydraulic actuators such as the left travel hydraulic motor 2ML, the right travel hydraulic motor 2MR, the boom cylinder 7, the arm cylinder 8, the bucket cylinder 9, and the swing hydraulic motor 2A.

Specifically, the control valve unit 17 includes multiple spool valves corresponding to the hydraulic actuators. Each spool valve is configured to be able to change its position according to a pilot pressure generated by the operating device 26 so as to be able to increase and decrease the opening area of a PC port and the opening area of a CT port. The PC port is a port that connects the main pump 14 and a hydraulic actuator. The CT port is a port that connects a hydraulic actuator and a hydraulic oil tank.

The operating device 26 includes, for example, a left operating lever, a right operating lever, and a travel operating device. The travel operating device includes, for example, a travel lever and a travel pedal. According to this embodiment, each operating device 26 is a hydraulic operating device that uses hydraulic oil discharged by the pilot pump 15, and is connected to the pilot ports of a corresponding spool valve in the control valve unit 17 via a pilot line. The operating device 26, however, may also be an electric operating device. In this case, the amount of operation of the electric operating device is input to the controller 30 as an electrical signal. Furthermore, a solenoid valve is placed between the pilot pump 15 and the pilot ports of each spool valve. The solenoid valve is configured to operate in response to an electrical signal from the controller 30. According to this configuration, when the electric operating device is manually operated, the controller 30 can move each spool valve in the control valve unit 17 by increasing or decreasing a pilot pressure by controlling the solenoid valve with an electrical signal commensurate with the amount of operation. Each spool valve may be constituted of a solenoid spool valve. In this case, the solenoid spool valve operates in response to an electrical signal from the controller 30 commensurate with the amount of operation of the electric operating device.

The operating pressure sensor 29 detects the details of an operation on the operating device 26 in the form of pressure. The operating pressure sensor 29 outputs a detection value to the controller 30. The details of an operation on the operating device 26 may also be electrically detected.

The selector valve 35 is configured to be able to switch the enabled state and the disabled state of the operating device 26. The enabled state of the operating device 26 denotes a state where the operator can operate the hydraulic actuators using the operating device 26. The disabled state of the operating device 26 denotes a state where the operator cannot operate the hydraulic actuators using the operating device 26. According to this embodiment, the selector valve 35 is a gate lock valve as a solenoid valve configured to operate in response to a command from the controller 30. Specifically, the selector valve 35 is placed in a pilot line connecting the pilot pump 15 and the operating device 26, and is configured to be able to switch the opening and closing of the pilot line in response to a command from the controller 30. For example, the operating device 26 is disabled when a gate lock lever D4 is pulled up to close the selector valve 35 (gate lock valve), and is enabled when the gate lock lever D4 is pushed down to open the selector valve 35 (gate lock valve).

An ignition switch (not depicted) is configured to be able to switch the state of the shovel 100. For example, the ignition switch is configured to be able to switch the state of the shovel 100 between a key-on state and a key-off state. The key-on state is a state of the shovel 100, and is entered, for example, when a mechanical key inserted into a key cylinder is turned to a first position (a position selected while the engine 11 is in operation). The key-off state is another state of the shovel 100, and is entered, for example, when the mechanical key inserted into the key cylinder is turned to a second position (a position at which the mechanical key can be taken out of the key cylinder) or when the mechanical key is taken out of the key cylinder.

According to this embodiment, the ignition switch is a key cylinder type of switch. The operator of the shovel 100 can select one of the OFF position, the ACC position (accessory position), the ON position, and the START position as the position of the ignition key by turning the mechanical key inserted into the key cylinder. When the ignition key is in the OFF position, the state of the shovel 100 is the key-off state. When the ignition switch is in the ACC position, the ON position, or the START position, the state of the shovel 100 is the key-on state. By selecting the ACC position or the ON position as the position of the ignition switch, the operator can activate the electrical equipment 73 installed in the shovel 100 without starting the engine 11. Furthermore, by selecting the START position as the position of the ignition switch, the operator can cause the engine 11 to be started by a starter 11*b*. Furthermore, by causing the position of the ignition switch to be the ON position after starting the engine 11, the operator can cause the engine 11 to continuously operate.

The main power supply 71 is a power supply used in both of the key-on state and the key-off state. According to this embodiment, the main power supply 71 is a rechargeable battery charged with electricity generated by an alternator 11*a*. The main power supply 71 is configured to be able to supply electric power to electrical loads such as the starter 11*b*, the controller 30, the display unit 40, and the electrical equipment 73 in the key-on state and to be able to supply electric power to the display unit 40 in the key-off state. The starter 11*b* is driven by electric power from the main power supply 71 to start the engine 11.

Specifically, the main power supply 71 is grounded via a power supply line PL1 and is configured to be connected to the display unit 40 via a switch 71*a*, a power supply line PL2, and a backup power supply line PL3. Furthermore, the main power supply 71 is configured to be connected to each electrical load via the switch 71*a*, the power supply line PL2, a relay 71*b*, and a main power supply line PL4. Furthermore, the main power supply 71 is configured to be connected to the relay 71*b* via the switch 71*a*, the power supply line PL2, a switch 71*c*, and a power supply line PL5.

The switch 71*a* is a switch for disconnecting the electrical loads from the main power supply 71. According to this embodiment, the switch 71*a* is installed near the main power supply 71 to be operable by a maintenance worker or the like, and is used by a maintenance worker or the like to disconnect the electrical loads from the main power supply 71 during maintenance work. The switch 71*a* is basically kept closed even in the key-off state except when maintenance work is performed.

The relay 71*b* is configured to be closed when the switch 71*c* is closed and be open when the switch 71*c* is open.

The switch 71*c* is configured to be closed when the position of the ignition switch is the ACC position, the ON position, or the START position and be open when the position of the ignition switch is the OFF position.

When the switch 71*c* is closed, the relay 71*b* is supplied with electric power from the main power supply 71 to active to be closed. When the relay 71*b* is closed, the power supply line PL2 and the main power supply line PL4 are connected, so that each electrical load is supplied with electric power from the main power supply 71 via the main power supply line PL4.

The display unit 40 may be connected to the controller 30 via a communication network such as a CAN or may be connected to the controller 30 via a dedicated line. According to this embodiment, the display unit 40 is connected to the controller 30 via a CAN.

The display unit 40 includes a control part 40*a*, an image display part 41, and an operation part 42. The control part 40*a* (an example of processing circuitry) controls an image displayed on the image display part 41. According to this embodiment, the control part 40*a* is constituted of a computer including a CPU, a volatile storage, and a nonvolatile storage. In this case, the control part 40*a* reads programs corresponding to functions from the nonvolatile storage into the nonvolatile storage, and causes the CPU to execute corresponding processes.

Specifically, the control part 40*a* is supplied with electric power from the main power supply 71 via the main power supply line PL4 to operate in the key-on state, and is supplied with electric power from the main power supply 71 via the backup power supply line PL3 to operate in the key-off state. Thus, the control part 40*a* is configured to be able to switch the activation and deactivation of the image display part 41 even when the engine 11 is stopped or the mechanical key is not inserted in the key cylinder. According to this embodiment, in the key-off state, the control part 40*a* is supplied with electric power from the main power supply 71 via the backup power supply line PL3 to operate, while other devices (electrical loads) such as the controller 30 do not operate with the supply of electric power.

The image display part 41 is configured to be able to display various images. According to this embodiment, the image display part 41 is a liquid crystal display, and is configured to be able to display an operation state screen (see FIG. 4) in the key-on state. The operation state screen may include, for example, a captured image captured by at least one image capturing device 80. The operation state screen may also be a menu screen including a condition screen showing the condition of the shovel 100, a setting screen showing various settings of the shovel 100, or the like.

The captured image may be, for example, a back image captured by the back camera 80B, a left image captured by the left camera 80L, or a right image captured by the right camera 80R. The captured image may also be, for example, an overhead view image into which captured images captured by the back camera 80B, the left camera 80L, and the right camera 80R are combined. Furthermore, the captured image may also be two or more images selected from the back image, the left image, the right image, and the overhead view image.

Furthermore, the image display part 41 is configured to be able to display a non-operation state screen (see FIG. 6) different from the operation state screen. The non-operation state screen may be, for example, a maintenance information screen that displays information on the maintenance of the shovel 100. The maintenance information screen may be, for example, a screen that displays information on the operating time of the engine 11. The non-operation state screen may be displayed on the image display part 41 in response to the operation of a predetermined button provided in an area surrounding the image display part 41 irrespective of whether the key-on state or the key-off state is entered.

The image display part 41 may also be configured to be able to display an abnormal state screen that is another example of the non-operation state screen in response to the interruption of a CAN communication between the controller 30 and the display unit 40 in the key-on state. In this case, the abnormal state screen is, for example, a screen that displays information indicating the occurrence of a CAN communication abnormality.

According to this embodiment, the control part 40*a* causes the image display part 41 to operate in response to the satisfaction of a predetermined activation condition in the key-off state. That is, the control part 40*a* causes electric power to be supplied from the main power supply 71 to the image display part 41 via the backup power supply line PL3. As a result, the image display part 41 can display the non-operation state screen. Examples of predetermined activation conditions include the switching of the state of the activation switch 51.

The activation switch 51 is placed at a position near a door 10D (see FIG. 1) of the cabin 10 and distant from the display unit 40. According to this embodiment, the activation switch 51 is a door switch that detects the opening of the door 10D, and is constituted of a limit switch. The activation switch 51, however, may also be a knob switch serving as a limit switch that detects the operation of a knob 10N (see FIG. 1) of the door 10D. The activation switch 51 may also be an electrostatic switch that detects the hand of a maintenance worker or the like touching the knob 10N. The activation switch 51 may also be a contactless human sensor switch that detects a maintenance worker or the like outside the door 10D. The activation switch 51 may also be a push-button switch placed outside the cabin 10 so that a maintenance worker or the like outside the door 10D can operate the activation switch 51 without opening the door 10D. The activation switch 51 may also be placed inside the cabin 10 and near the door 10D. Specifically, the activation switch 51 may be placed as a push-button switch on a left console on the left side of the operator seat. The activation switch 51 may also a combination of two or more of the above-described types of switches.

The activation switch 51 may also be configured to be able to detect an approaching terminal carried by a maintenance worker or the like via short-range radio communications. A terminal carried by a maintenance worker or the like is, for example, a terminal used in an electronic key system such as a keyless entry system or a smart keyless entry system. Typically, the terminal is an electronic key, a smartphone or the like. In this case, the activation switch 51 installed in the door 10D of the shovel 100 is configured to switch from an open state to a closed state in response to, for example, the approaching of a terminal carried by a maintenance worker or the like to the door 10D.

Specifically, the control part 40*a* detects the switching of the state of the activation switch 51 from an open state to a closed state and determines that a predetermined activation condition is satisfied, in response to the opening of the door 10D in the key-off state.

The control part 40*a* deactivates the image display part 41 in response to the satisfaction of a predetermined stop condition in the key-off state. That is, the control part 40*a* prevents electric power from being supplied from the main power supply 71 to the image display part 41 via the backup power supply line PL3. As a result, the image display part 41 prevents the non-operation time state from being displayed.

Examples of predetermined stop conditions include the returning of the activation switch 51 to its original state and the passage of a predetermined maximum activation time since the activation of the image display part 41. The maximum activation time is, for example, several dozen seconds.

Specifically, the control part 40*a* detects the returning of the state of the activation switch 51 from a closed state to an open state and determines that a predetermined stop condition is satisfied, in response to the closing of the open door 10D in the key-off state. The control part 40*a* may also determine that a predetermined stop condition is satisfied in response to the passage of the predetermined maximum operation time since the activation of the image display part 41 in the key-off state.

The operation part 42 is a switch panel including hardware switches. The operation part 42 may also be a touch-screen. According to this embodiment, the operation part 42 is placed below the image display part 41. The operation part 42, however, may also be placed on the surface of an operating lever, may also be placed on the left console on the left side of the operator seat, or may also be placed on a right console on the right side of the operator seat.

The room light 52 is a lighting device that illuminates the inside of the cabin 10. According to this embodiment, the room light 52 is configured to turn on in response to the opening of the door 10D. As described above, the control part 40*a* is configured to be able to determine whether the door 10D of the cabin 10 is opened or not based on the state of the activation switch 51. According to this configuration, the control part 40*a* can output a control command to the room light 52 to turn on the room light 52 in response to determining that the door 10D is opened. The room light 52 is configured to be supplied with electric power from the main power supply 71 via the backup power supply line PL3 in the key-off state.

The engine control unit 74 is configured to transmit data on the condition of the engine 11, such as coolant water temperature, to the controller 30. A regulator 14*a* of the main pump 14 is configured to transmit data on a swash plate tilt angle to the controller 30. A discharge pressure sensor 14*b* is configured to transmit data on the discharge pressure of the main pump 14 to the controller 30. An oil temperature sensor 14*c* provided in a conduit between the hydraulic oil tank and the main pump 14 is configured to transmit data on the temperature of hydraulic oil flowing through the conduit to the controller 30. The operating pressure sensor 29 is configured to transmit data on a pilot pressure generated when the operating device 26 is operated to the controller 30. The controller 30 is configured to be able to store these data in the volatile storage or the nonvolatile storage and transmit these data to the display unit 40 when needed.

The engine rotational speed adjustment dial 75 is a dial for adjusting the rotational speed of the engine 11. The engine rotational speed adjustment dial 75 is configured to transmit data on the setting of the engine rotational speed to the controller 30. The engine rotational speed adjustment dial 75 is configured to be able to select the engine rotational speed from the four levels of SP mode, H mode, A mode, and IDLE mode. The SP mode is a rotational speed mode that is selected when it is desired to prioritize workload, and uses the highest engine rotational speed. The H mode is a rotational speed mode that is selected when it is desired to satisfy both workload and fuel efficiency, and uses the second highest engine rotational speed. The A mode is a rotational speed mode that is selected when it is desired to operate the shovel 100 with low noise while prioritizing fuel efficiency, and uses the third highest engine rotational speed. The IDLE mode is a rotational speed mode that is selected when it is desired to idle the engine 11, and uses the lowest engine rotational speed. The engine 11 is controlled to be constant at an engine rotational speed corresponding to a rotational speed mode set with the engine rotational speed adjustment dial 75. The engine rotational speed adjustment dial 75 is provided with the output characteristic selector switch 76. The operator of the shovel 100 can change the output characteristic of the shovel 100 by depressing the output characteristic selector switch 76. The output characteristic selector switch 76 may be depressed to change an engine output torque diagram or decrease the engine rotational speed at each level of the engine rotational speed adjustment dial 75 by a predetermined value.

Figure 4:
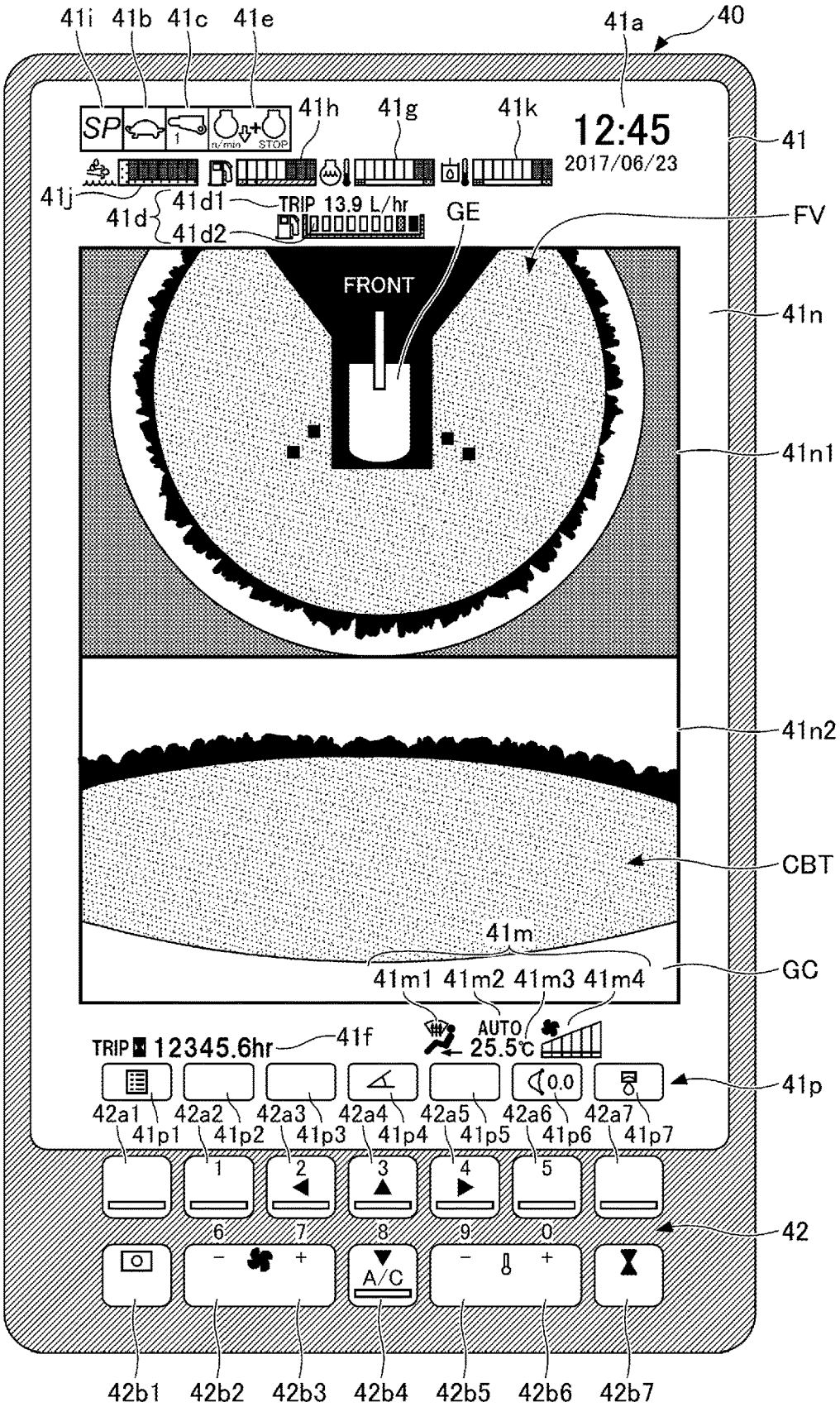
FIG. 4 is a diagram illustrating an example of an operation state screen.

Next, the operation state screen is described with reference to FIG. 4. FIG. 4 illustrates an example of the operation state screen.

In the key-on state, the image display part 41 includes a date and time display area 41*a*, a travel mode display area 41*b*, an attachment display area 41*c*, a fuel efficiency display area 41*d*, an engine control status display area 41*e*, an engine operating time display area 41*f*, a coolant water temperature display area 41*g*, a remaining fuel amount display area 41*h*, a rotational speed mode display area 41*i*, a remaining aqueous urea solution amount display area 41*j*, a hydraulic oil temperature display area 41*k*, an air conditioner operating state display area 41*m*, an image display area 41*n*, and a menu display area 41*p*.

The travel mode display area 41*b*, the attachment display area 41*c*, the engine control status display area 41*e*, the rotational speed mode display area 41*i*, and the air conditioner operating state display area 41*m* are areas for displaying settings information that is information on the settings of the shovel 100. The fuel efficiency display area 41*d*, the engine operating time display area 41*f*, the coolant water temperature display area 41*g*, the remaining fuel amount display area 41*h*, the remaining aqueous urea solution amount display area 41*j*, and the hydraulic oil temperature display area 41*k* are areas for displaying operating state information that is information on the operating state of the shovel 100.

The date and time display area 41*a* is an area for displaying a current date and time. The travel mode display area 41*b* is an area for displaying a current travel mode. The attachment display area 41*c* is an area for displaying an image that represents a currently attached attachment. The fuel efficiency display area 41*d* is an area for displaying fuel efficiency information calculated by the controller 30. The fuel efficiency display area 41*d* includes an average fuel efficiency display area 41*d*1 for displaying average fuel efficiency with respect to the entire period or average fuel efficiency with respect to a partial period and an instantaneous fuel efficiency display area 41*d*2 for displaying instantaneous fuel efficiency. The entire period means, for example, the entirety of a period after the shipment of the shovel 100. The partial period means, for example, an arbitrary period set by the operator.

The engine control status display area 41*e* is an area for displaying the control status of the engine 11. The engine operating time display area 41*f* is an area for displaying the operating time of the engine 11. The coolant water temperature display area 41*g* is an area for displaying the current temperature condition of engine coolant water. The remaining fuel amount display area 41*h* is an area for displaying the state of the remaining amount of fuel stored in a fuel tank. The rotational speed mode display area 41*i* is an area for displaying a current rotational speed mode set with the engine rotational speed adjustment dial 75 as an image. The remaining aqueous urea solution amount display area 41*j* is an area for displaying the state of the remaining amount of an aqueous urea solution stored in an aqueous urea solution tank as an image. The hydraulic oil temperature display area 41*k* is an area for displaying the state of the temperature of hydraulic oil in the hydraulic oil tank.

The air conditioner operating state display area 41*m* includes a vent display area 41*m*1 for displaying the position of a current vent, an operating mode display area 41*m*2 for displaying a current operating mode, a temperature display area 41*m*3 for displaying a current set temperature, and an air volume display area 41*m*4 for displaying a current set air volume.

The image display area 41*n* is an area for displaying an image captured by the image capturing device 80. The image display area 41*n* includes a first image display area 41*n*1 positioned above and a second image display area 41*n*2 positioned below. According to the example of FIG. 4, an overhead view image FV is placed in the first image display area 41*n*1 and a back image CBT is placed in the second image display area 41*n*2. The image display area 41*n*, however, may also be such that the overhead view image FV is placed in the second image display area 41*n*2 and the back image CBT is placed in the first image display area 41*n*1. Furthermore, the overhead view image FV and the back image CBT, which are arranged vertically next to each other according to the example of FIG. 4, may be arranged vertically spaced apart from each other.

The overhead view image FV, which is a virtual viewpoint image generated by the control part 40*a*, is generated based on images captured by the back camera 80B, the left camera 80L, and the right camera 80R. Furthermore, a shovel graphic GE corresponding to the shovel 100 is placed in the center of the overhead view image FV, in order to cause the operator to intuitively understand the positional relationship between the shovel 100 and an object present in an area surrounding the shovel 100. The back image CBT is an image showing a space behind the shovel 100, and includes an image GC that represents part of the upper surface of the counterweight. The back image CBT is a real viewpoint image generated by the control part 40*a*, and is generated based on an image captured by the back camera 80B.

The image display area 41*n*, which is a vertically elongated area according to the example of FIG. 4, may also be a laterally elongated area. When the image display area 41*n* is a laterally elongated area, the image display area 41*n* may include the overhead view image FV as the first image display area 41*n*1 on the left side and may include the back image CBT as the second image display area 41*n*2 on the right side. In this case, the overhead view image FV may be positioned to the left of and spaced apart from the back image CBT. The overhead view image FV may also be positioned to the right of the back image CBT.

The menu display area 41*p* includes tab areas 41*p*1 through 41*p*7. According to the example of FIG. 4, the tab areas 41*p*1 through 41*p*7 are laterally spaced apart from each other at the bottom of the image display part 41. An icon representing the contents of associated information is displayed in each of the tab areas 41*p*1 through 41*p*7.

In the tab area 41*p*1, a menu specific item icon for displaying menu specific items is displayed. When the operator selects the tab area 41*p*1, the icons displayed in the tab areas 41*p*2 through 41*p*7 switch to icons associated with the menu specific items.

In the tab area 41*p*4, an icon for displaying digital level-related information is displayed. When the operator selects the tab area 41*p*4, the back image CBT switches to a first screen showing the digital level-related information.

In the tab area 41*p*6, an icon for displaying intelligent construction-related information is displayed. When the operator selects the tab area 41*p*6, the back image CBT switches to a second screen showing the intelligent construction-related information.

In the tab area 41*p*7, an icon for displaying crane mode-related information is displayed. When the operator selects the tab area 41*p*7, the back image CBT switches to a third screen showing the crane mode-related information.

Any menu screen such as the first screen, the second screen or the third screen may be superimposed and displayed over the back image CBT. The back image CBT may also be reduced to make room for displaying a menu screen. The overhead view image FV may also be configured to switch to a menu screen. The menu screen may also be superimposed and displayed over the overhead view image FV. The overhead view image FV may also be reduced to make room for displaying a menu screen.

According to the example illustrated in FIG. 4, no icons are displayed in the tab areas 41*p*2, 41*p*3, and 41*p*5. Therefore, even when the operator operates the tab area 41*p*2, 41*p*3, or 41*p*5, the image displayed on the image display part 41 does not change.

The icons displayed in the tab areas 41*p*1 through 41*p*7 are not limited to the above-described examples, and icons for showing other information may also be displayed.

According to the example of FIG. 4, the operation part 42 is composed of multiple button switches for the operator making a selection from among the tab areas 41*p*1 through 41*p*7, inputting settings, etc. Specifically, the operation part 42 includes seven switches 42*a*1 through 42*a*7 placed in the upper row and seven switches 42*b*1 through 42*b*7 placed in the lower row. The switches 42*b*1 through 42*b*7 are placed below the switches 42*a*1 through 42*a*7, respectively. The number, form, and arrangement of switches of the operation part 42, however, are not limited to the above-described example. For example, like a jog wheel, a jog switch or the like, the operation part 42 may be a single unit into which the functions of multiple button switches are integrated. The operation part 42 may also be configured as a member independent of the display unit 40. Furthermore, the tab areas 41*p*1 through 41*p*7 may be configured as software buttons. In this case, the operator can select desired tab areas by touching the tab areas 41*p*1 through 41*p*7.

According to the example of FIG. 4, the switch 42*a*1 is placed below the tab area 41*p*1 to correspond to the tab area 41*p*1, and functions as a switch for selecting the tab area 41*p*1. The same is the case with each of the switches 42*a*2 through 42*a*7.

This configuration enables the operator to intuitively determine which of the switches 42*a*1 through 42*a*7 to operate to select a desired one of the tab areas 41*p*1 through 41*p*7.

The switch 42*b*1 is a switch for switching captured images displayed in the image display area 41*n*. The display unit 40 is configured such that the captured image displayed in the first image display area 41*n*1 of the image display area 41*n* switches in order, for example, from a back image to a left image to a right image to an overhead view image each time the switch 42*b*1 is operated. The display unit 40 may also be configured such that the captured image displayed in the second image display area 41*n*2 of the image display area 41*n* switches in order, for example, from a back image to a left image to a right image to an overhead view image each time the switch 42*b*1 is operated. The display unit 40 may also be configured such that the captured image displayed in the first image display area 41*n*1 of the image display area 41*n* and the captured image displayed in the second image display area 41*n*2 of the image display area 41*n* interchange each time the switch 42*b*1 is operated.

Thus, the operator may switch a screen displayed in the first image display area 41*n*1 or the second image display area 41*n*2 by operating the switch 42*b*1 serving as the operation part 42. The operator may also switch screens displayed in the first image display area 41*n*1 and the second image display area 41*n*2 by operating the switch 42*b*1. The display unit 40 may include a separate switch for switching a screen displayed in the second image display area 41*n*2.

The switches 42*b*2 and 42*b*3 are switches for controlling the air volume of an air conditioner. According to the example of FIG. 4, the operation part 42 is configured such that the switch 42*b*2 is operated to decrease the air volume of the air conditioner and the switch 42*b*3 is operated to increase the air volume of the air conditioner.

The switch 42*b*4 is a switch for switching the turning on and off of a cooling/heating function. According to the example of FIG. 4, the operation part 42 is configured such that each time the switch 42*b*4 is operated, the cooling/heating function is switched between ON and OFF.

The switches 42*b*5 and 42*b*6 are switches for controlling the set temperature of the air conditioner. According to the example of FIG. 4, the operation part 42 is configured such that the switch 42*b*5 is operated to decrease the set temperature and the switch 42*b*6 is operated to increase the set temperature.

The switch 42*b*7 is a switch for changing the contents of information on the operating time of the engine 11 displayed in the engine operating time display area 41*f*. The information on the operating time of the engine 11 includes, for example, a cumulative operating time associated with the entire period and a cumulative operating time associated with a partial period.

Furthermore, each of the switches 42*a*2 through 42*a*6 and 42*b*2 through 42*b*6 is configured to be able to input a number shown on or near the switch. Furthermore, the switches 42*a*3, 42*a*4, 42*a*5, and 42*b*4 are configured to be able to move a cursor left, up, right, and down, respectively, when the cursor is displayed on the image display part 41.

The above-described functions assigned to the switches 42*a*1 through 42*a*7 and 42*b*1 through 42*b*7 are examples. The switches 42*a*1 through 42*a*7 and 42*b*1 through 42*b*7 may also be configured to be able to execute other functions.

Figure 5:
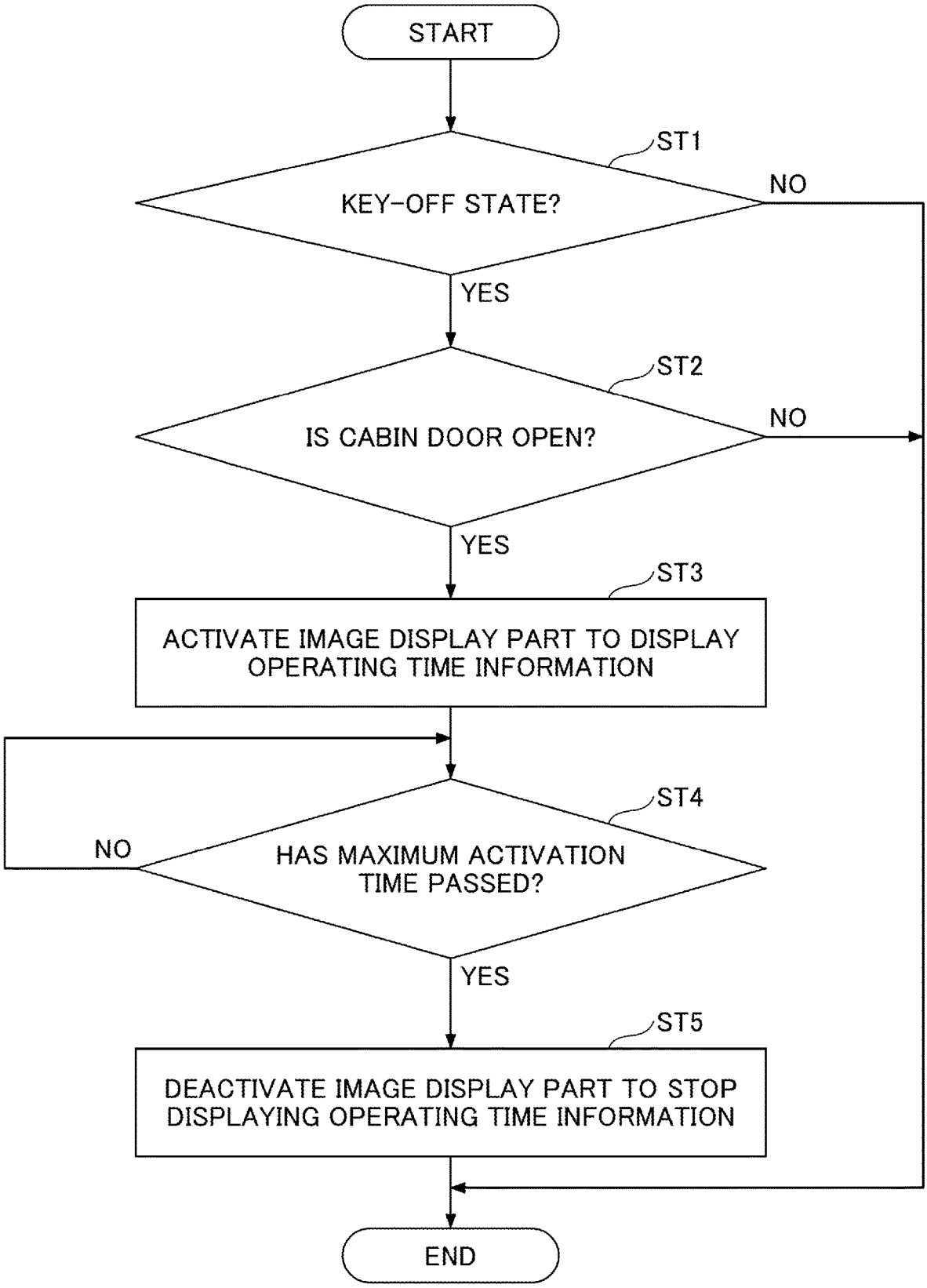
FIG. 5 is a flowchart of a switching process.

Next, an example of the process of switching the activation and deactivation of the image display part 41 executed by the control part 40*a* in the key-off state (hereinafter "switching process") is described with reference to FIG. 5. FIG. 5 is a flowchart of an example of the switching process. In the key-off state, the control part 40*a* is supplied with electric power from the main power supply 71 (see FIG. 3) via the backup power supply line PL3 to repeatedly execute this switching process at predetermined control intervals.

First, the control part 40*a* determines whether the state of the shovel 100 is the key-off state (step ST1). According to this embodiment, the control part 40*a* determines whether the state of the shovel 100 is the key-off state based on via which of the backup power supply line PL3 and the main power supply line PL4 the control part 40*a* is supplied with electric power. Specifically, the control part 40*a* determines that the state of the shovel 100 is the key-off state when the control part 40*a* is supplied with electric power via the backup power supply line PL3, and determines that the state of the shovel 100 is not the key-off state when the control part 40*a* is supplied with electric power via the main power supply line PL4.

In response to determining that the key-off state is not entered (NO at step ST1), the control part 40*a* ends the switching process of this time.

In response to determining that the key-off state is entered (YES at step ST1), the control part 40*a* determines whether the door 10D of the cabin 10 is open (step ST2). According to this embodiment, the control part 40*a* determines whether the door 10D is open based on the output of a door switch serving as the activation switch 51.

In response to determining that the door 10D is not open (NO at step ST2), the control part 40*a* ends the switching process of this time.

In response to determining that the door 10D is open (YES at step ST2), the control part 40*a* activates the image display part 41 to display information on the operating time of the shovel 100 (step ST3). According to this embodiment, the control part 40*a* causes a maintenance information screen (see FIG. 6) serving as the non-operation state screen to be displayed on the image display part 41 by causing electric power to be supplied from the main power supply 71 to the image display part 41 via the backup power supply line PL3.

Thereafter, the control part 40*a* determines whether the maximum activation time has passed (step ST4). According to this embodiment, the control part 40*a* monitors whether the time that has elapsed since the activation of the image display part 41 has reached a predetermined maximum activation time, using an included timer function. The control part 40*a* repeats this determination at predetermined control intervals until the elapsed time reaches the maximum activation time (NO at step ST4).

In response to determining that the maximum activation time has passed (YES at step ST4), the control part 40*a* deactivates the image display part 41 to stop displaying the information on the operating time of the shovel 100 (step ST5). According to this embodiment, the control part 40*a* causes the display of the maintenance information screen on the image display part 41 to be stopped by preventing electric power from being supplied from the main power supply 71 to the image display part 41 via the backup power supply line PL3. As a result, the maintenance information screen displayed on the image display part 41 is cleared irrespective of the state of the activation switch 51.

This switching process enables a maintenance worker or the like to view information on the operating time of the shovel 100 displayed on the image display part 41 by just opening the door 10D of the cabin 10 without riding in the cabin 10. A maintenance worker may be required to write down the operating time of the shovel 100, a date, etc., on a check sheet when performing the maintenance of the shovel 100, following maintenance and inspection guidelines or the like, for example. In this case, the maintenance worker can write down the operating time of the shovel 100 on the check sheet without riding in the cabin 10 and activating the display unit 40 by viewing information on the operating time of the shovel 100 displayed on the image display part 41.

Furthermore, the display unit 40 has the image display part 41 so positioned as to be visible from outside the door 10D. That is, the image display part 41 is so positioned as not to be hidden from a maintenance worker or the like outside the door 10D by an operating lever, etc. Therefore, a maintenance worker or the like can view information on the operating time of the shovel 100 displayed on the image display part 41 without being in an unnatural position.

Furthermore, a glass window 10W (see FIG. 1) is attached to the door 10D. Therefore, a maintenance worker or the like can view information on the operating time of the shovel 100 displayed on the image display part 41 through the glass window 10W by slightly opening the door 10D without fully opening the door 10D.

When the activation switch 51 is configured to be able to detect an approaching terminal carried by a maintenance worker or the like, the maintenance worker or the like can view information on the operating time of the shovel 100 displayed on the image display part 41 through the glass window 10W by just approaching the door 10D. In this case, the maintenance worker or the like does not have to open the door 10D to view information on the operating time of the shovel 100 displayed on the image display part 41.

The image display part 41 may also be configured not to be activated in response to the first switching of the activation switch 51 after the transition of the state of the shovel 100 from the key-on state to the key-off state. The image display part 41 may also be configured not to be activated before a predetermined no-activation time passes since the transition of the key-on state to the key-off state. This is for preventing the image display part 41 from being activated when the operator who has finished operating the shovel 100 opens the door 10D to get out of the cabin 10.

Specifically, the image display part 41 is normally deactivated by the interruption of the supply of electric power when the state of the shovel 100 transitions from the key-on state to the key-off state. Therefore, if the image display part 41 is activated when the operator opens the door 10D to get out of the cabin 10, the operator may incorrectly understand that the image display part 41 is not properly deactivated. The above-described function can prevent such misunderstanding.

The image display part 41, however, may also be configured to be activated in response to the first switching of the activation switch 51 after the transition of the state of the shovel 100 from the key-on state to the key-off state. The image display part 41 may also be configured to be activated even immediately after the transition from the key-on state to the key-off state. This is for controlling or preventing the occurrence of problems such as a failure by simplifying functions by omitting exceptional processes.

Figure 6:
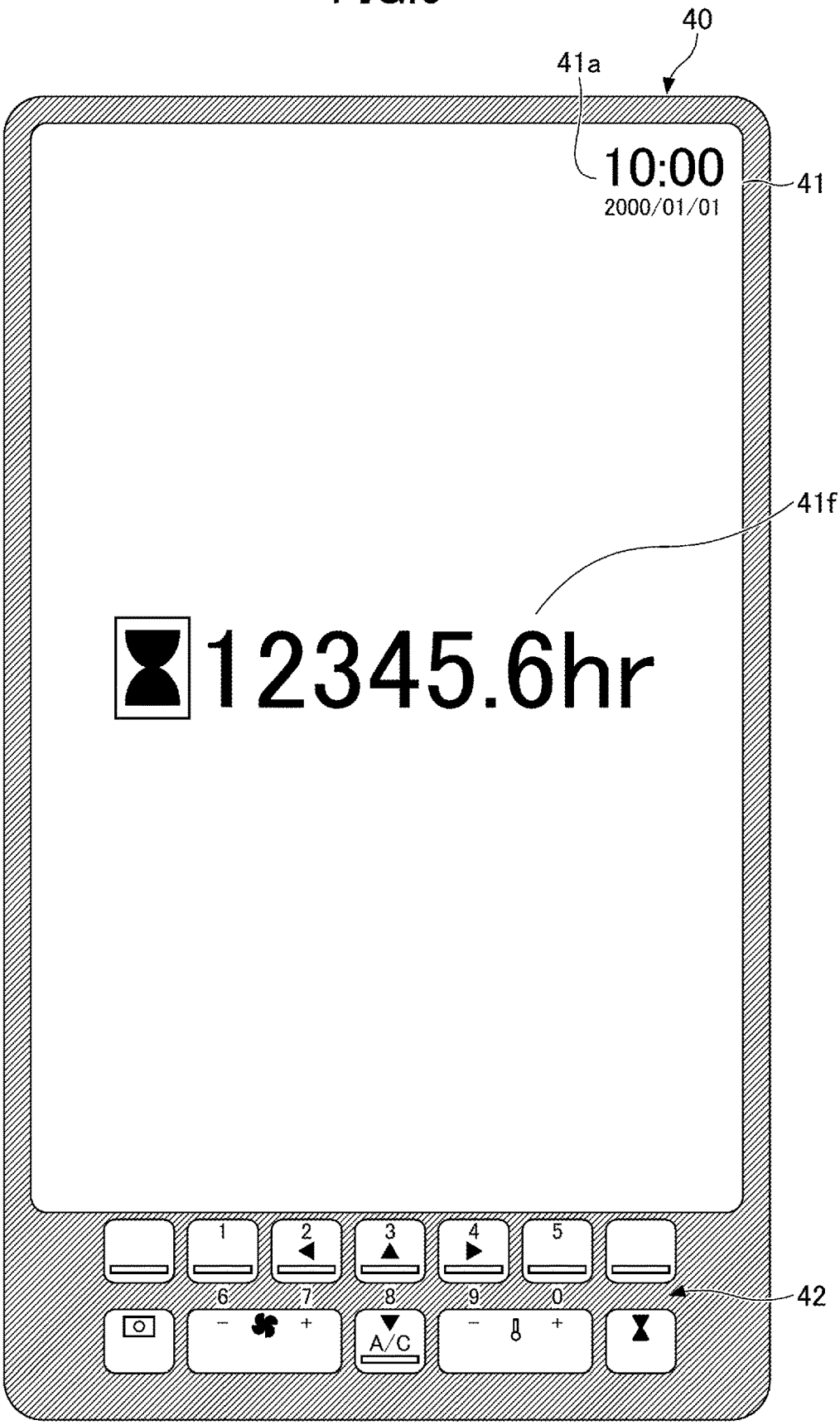
FIG. 6 is a diagram illustrating an example of a non-operation state screen.

Next, the non-operation state screen is described with reference to FIG. 6. FIG. 6 illustrates an example of the non-operation state screen.

According to the example illustrated in FIG. 6, the non-operation state screen displayed on the image display part 41 in the key-off state includes the date and time display area 41*a* and the engine operating time display area 41*f*. Specifically, the control part 40*a* causes the entire display area of the image display part 41 to be displayed in black, causes a cumulative operating time to be displayed in white in the center, and causes a date and time to be displayed at the upper right corner in white.

The size of a character (for example, a number) displayed in the engine operating time display area 41*f* included in the non-operation state screen is larger than the size of a character displayed in the engine operating time display area 41*f* included in the operation state screen (see FIG. 4).

Furthermore, according to the non-operation state screen, the entire display area except for the date and time display area 41*a* and the engine operating time display area 41*f* is displayed in a single color (black), and numerical values, symbols, etc., in each of the date and time display area 41*a* and the engine operating time display area 41*f* are displayed in another color (white). According to the non-operation state screen, no other information is displayed around the engine operating time display area 41*f* placed in the center.

Thus, the non-operation state screen is configured such that even a maintenance worker or the like outside the door 10D can easily view information on the operating time. Therefore, even the maintenance worker or the like outside the door 10D, namely, a maintenance worker or the like who is more distant from the display unit 40 than is the operator sitting in the operator seat, can easily view (identify) characters displayed in the engine operating time display area 41*f*.

The non-operation state screen may omit the display of the date and time display area 41*a*. This is for further improving the visibility of information necessary for a maintenance worker or the like (for example, information on the operating time) by omitting the display of information other than the information necessary for a maintenance worker or the like.

The non-operation state screen may also display, as information necessary for a maintenance worker or the like, at least one of information on the remaining amount of fuel, information on the remaining amount of an aqueous urea solution, information on errors, etc. In this case, the information on the remaining amount of fuel, the information on the remaining amount of an aqueous urea solution, and the information on errors are, for example, information stored in a storage at the time of the switching of the state of the shovel 100 from the last key-on state to a current key-off state.

The non-operation state screen may also display information necessary for the operator of the shovel 100 instead of information necessary for a maintenance worker or the like. Specifically, for example, when an electronic key system such as a keyless entry system or a smart keyless entry system is installed in the shovel 100, the non-operation state screen may display information on an engine start procedure.

Figure 7:
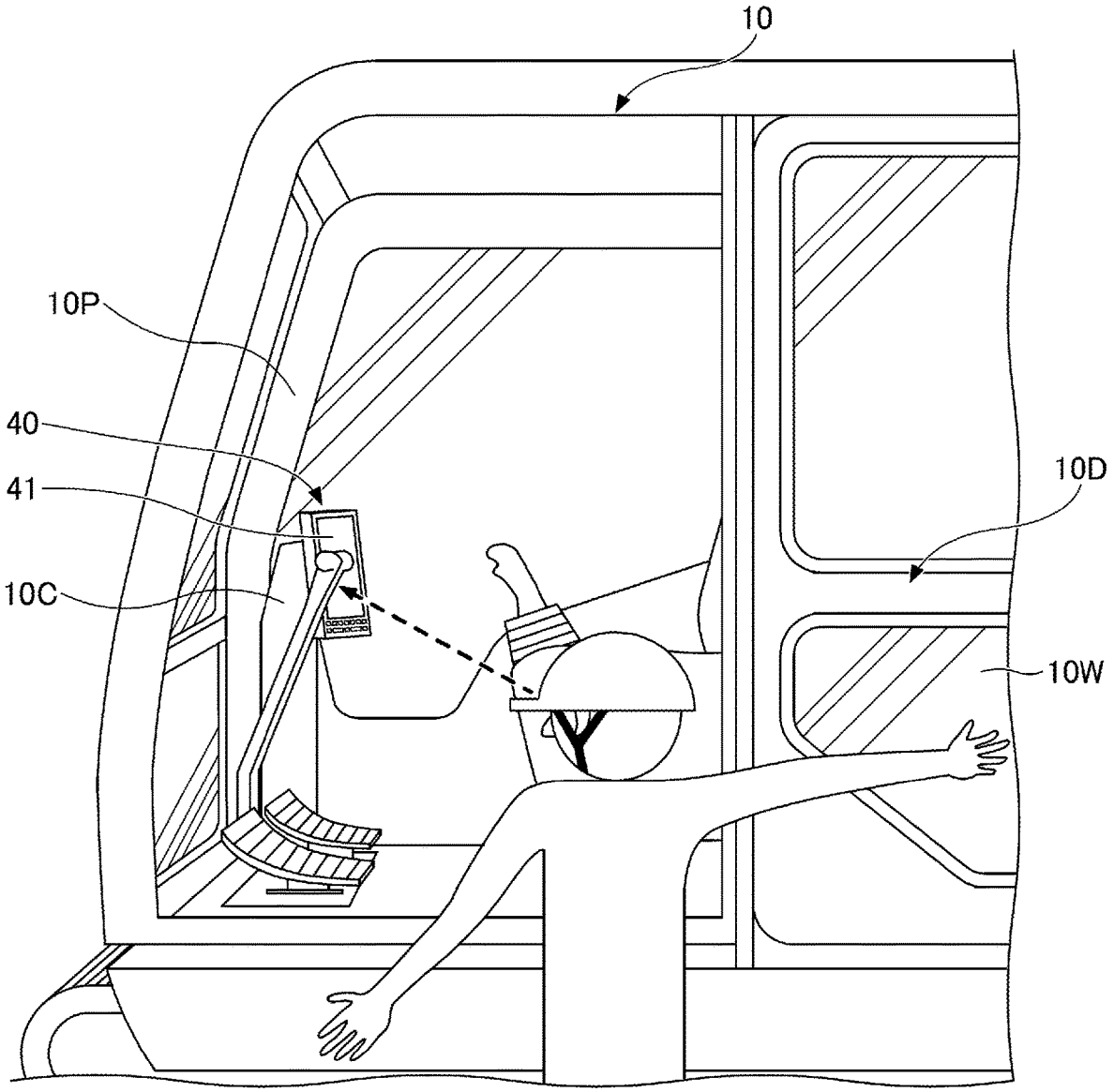
FIG. 7 is a left side view of the shovel of FIG. 1.

Next, effects produced by the shovel 100 including the control part 40*a* that can execute the switching process are described with reference to FIG. 7. FIG. 7 is a left side view of the shovel 100, illustrating a state where the door 10D is widely opened by a maintenance worker wearing a helmet outside the door 10D.

As illustrated in FIG. 7, the display unit 40 is placed between a right pillar 10P and the operator seat. Specifically, the display unit 40 is attached to a front right console 10C in front of the right pillar 10P such that the screen faces the operator seat. When the maintenance worker opens the door 10D, the control part 40*a* of the display unit 40 activates the image display part 41 to display the non-operation state screen as illustrated in FIG. 6. This function enables the maintenance worker to view the operating time of the shovel 100 shown in the non-operation state screen without riding in the cabin 10. The image display part 41 is not hidden by the operator seat, an operating lever, or the like.

The maintenance worker may also activate the image display part 41 to display the non-operation state screen by slightly opening the door 10D. In this case, the maintenance worker can view the operating time of the shovel 100 shown in the non-operation state screen through the glass window 10W fitted into a lower portion of the door 10D.

The shovel 100 may also be configured to be able to activate the image display part 41 when the maintenance worker operates the knob 10N of the door 10D or touches the knob 10N. The shovel 100 may also be configured to be able to activate the image display part 41 in response to detecting the maintenance worker close by outside the door 10D in a contactless manner. In these cases, the maintenance worker can view the operating time of the shovel 100 shown in the non-operation state screen through the glass window 10W fitted into a lower portion of the door 10D as described above.

As described above, the shovel 100 according to an embodiment of the present invention includes the lower traveling structure 1, the upper swing structure 3 swingably mounted on the lower traveling structure 1, the cabin 10 serving as a cab mounted on the upper swing structure 3, the door 10D provided in the cabin 10, the display unit 40 placed in the cabin 10, and the activation switch 51 placed at a position near the door 10D and distant from the display unit 40. The shovel 100 is configured to output information stored in a storage installed in the shovel 100 in response to the switching of the activation switch 51. According to this configuration, the shovel 100 enables a maintenance worker or the like to easily view information stored in the storage device.

Specifically, in the key-off state, the shovel 100 can implement the function of displaying information stored in the nonvolatile storage installed in the shovel 100 to a maintenance worker or the like outside the cabin 10 by activating the image display part 41 of the display unit 40. In the key-off state, the shovel 100 can also implement the function of communicating information stored in the nonvolatile storage to a maintenance worker or the like outside the cabin 10 by voice by activating a sound output device. Therefore, a maintenance worker or the like can obtain information stored in the nonvolatile storage from outside the cabin 10 without riding in the cabin 10.

The activation switch 51 is desirably a door switch configured to detect the opening and closing of the door 10D. According to this configuration, the control part 40*a* can determine whether to activate the image display part 41 in the key-off state based on the output of an existing door switch used in determining whether to turn on the room light 52. That is, the shovel 100 can implement the above-described functions without requiring installation of a new switch.

The display unit 40 is desirably configured to display information on the operating time of the engine 11. According to this configuration, a maintenance worker or the like can check the operating time of the engine 11 without riding in the shovel 100.

The display unit 40 desirably has the image display part 41 so positioned as to be visible from outside the door 10D. The shovel 100 is desirably configured to activate the image display part 41 in response to the switching of the activation switch 51. According to this configuration, a maintenance worker or the like outside the door 10D can view desired information by just opening the door 10D without being in an unnatural position.

The shovel 100 may also be configured to deactivate the image display part 41 in response to the passage of the maximum activation time, which is a predetermined first time, since activating the image display part 41 in response to the opening of the door 10D. According to this configuration, the shovel 100 can prevent the image display part 41 from being kept activated for a long period of time in the key-off state.

The image display part 41 may also be configured not to be activated in response to the first switching of the activation switch 51 after the transition of the state of the shovel 100 from the key-on state to the key-off state. The image display part 41 may also be configured not to be activated before the passage of the no-activation time, which is a predetermined second time, since the transition of the state of the shovel 100 from the key-on state to the key-off state. According to this configuration, the shovel 100 can prevent the image display part 41 from being activated when the operator who has finished operating the shovel 100 opens the door 10D to get out of the cabin 10. This is because if the image display part 41 is activated when the operator opens the door 10D to get out of the cabin 10, the operator may incorrectly understand that the image display part 41 remains activated.

The display unit 40 is desirably configured to display, on the image display part 41, the non-operation state screen (see FIG. 6) different from the operation state screen (see FIG. 4) displayed on the image display part 41 in the key-on state, in response to the switching of the activation switch 51.

Characters shown in the non-operation state screen are desirably larger than characters shown in the operation state screen. This is because while the operation state screen is viewed by the operator sitting in the operator seat in the cabin 10, the non-operation state screen is viewed by a maintenance worker or the like outside the door 10D.

Furthermore, the display position of predetermined information in the non-operation state screen is desirably different from the display position of the predetermined information in the operation state screen. For example, the engine operating time display area 41*f*, which is positioned at the lower left of the image display part 41 in the operation state screen illustrated in FIG. 4, is positioned in the center of the image display part 41 in the non-operation state screen illustrated in FIG. 6. This is for further ensuring that a maintenance worker or the like who looks at the non-operation state screen can view desired information (information on the operating time of the engine 11).

Furthermore, the number of items of information shown in the non-operation state screen is desirably smaller than the number of items of information shown in the operation state screen. For example, according to the operation state screen illustrated in FIG. 4, the image display part 41 includes the date and time display area 41*a*, the travel mode display area 41*b*, the attachment display area 41*c*, the fuel efficiency display area 41*d*, the engine control status display area 41*e*, the engine operating time display area 41*f*, the coolant water temperature display area 41*g*, the remaining fuel amount display area 41*h*, the rotational speed mode display area 41*i*, the remaining aqueous urea solution amount display area 41*j*, the hydraulic oil temperature display area 41*k*, the air conditioner operating state display area 41*m*, the image display area 41*n*, and the menu display area 41*p*. According to the non-operation state screen illustrated in FIG. 6, however, the image display part 41 only includes the date and time display area 41*a* and the engine operating time display area 41*f*. This is for enabling a maintenance worker or the like to check desired information (information on the operating time of the engine 11) without confusion. For the same reason, the non-operation state screen desirably does not include an area for displaying a video, such as the image display area 41*n*.

Furthermore, the number of colors used in the non-operation state screen is desirably smaller than the number of colors used in the operation state screen. For example, the number of colors used in the operation state screen illustrated in FIG. 4 is substantially unlimited, while the number of colors used in the non-operation state screen illustrated in FIG. 6 is limited to two (black as a background color and white as a character color). This is for improving the visibility of information necessary for a maintenance worker or the like.

An embodiment of the present invention is described in detail above. The present invention, however, is not limited to the above-described embodiment. Various variations, substitutions, etc., may be applied to the above-described embodiment without departing from the scope of the present invention. Furthermore, separately described features may be combined to the extent that no technical contradiction is caused.

For example, according to the above-described embodiment, the activation and deactivation of the image display part 41 in the key-off state is controlled by the control part 40*a* that is supplied with electric power from the main power supply 71 via the backup power supply line PL3 in the key-off state. The activation and deactivation of the image display part 41 in the key-off state, however, may be controlled by another device (electronic circuitry) supplied with electric power from the main power supply 71 via the backup power supply line PL3 in the key-off state (for example, the controller 30, the image capturing device 80, or the like).

Furthermore, according to the above-described embodiment, the control part 40*a* is configured to activate the image display part 41 in response to the satisfaction of the predetermined activation condition. The control part 40*a*, however, may also be configured to activate a sound output device in response to the satisfaction of the predetermined activation condition. In this case, the sound output device may be configured to, for example, output maintenance-related sound information to a maintenance worker or the like outside the cabin 10. Specifically, the sound output device may also be configured to, for example, output sound information about the operating time of the engine 11 to a maintenance worker or the like.

Furthermore, according to the above-described embodiment, the door switch serving as the activation switch 51 is used when the control part 40*a* determines whether to activate the image display part 41 in the key-off state and is used when the control part 40*a* determines whether to turn on the room light 52. That is, the activation switch 51 is used to implement two functions. The activation switch 51, however, may be a dedicated switch used only for the control part 40*a* to determine whether to activate the image display part 41 in the key-off state. In this case, the activation switch 51 may be a push button placed outside the cabin 10.

What is claimed is:

1. A shovel comprising:

a lower traveling structure;

an upper swing structure swingably mounted on the lower traveling structure;

a cab mounted on the upper swing structure;

a door provided on the cab;

a display placed in the cab;

a switch placed at a position near the door and distant from the display; and processing circuitry configured to output information stored in the shovel in response to switching of the switch, the information including information on maintenance of the shovel.

2. The shovel as claimed in claim 1, wherein the switch is configured to detect opening and closing of the door.

3. The shovel as claimed in claim 1, wherein the processing circuitry is configured to display information on an operating time of an engine on the display.

4. The shovel as claimed in claim 1, wherein the display is so positioned as to be visible from outside the door.

5. The shovel as claimed in claim 4, wherein the processing circuitry is configured to activate the display in response to the switching of the switch.

6. The shovel as claimed in claim 5, wherein the processing circuitry is configured to deactivate the display in response to passage of a predetermined first time since the activation of the display.

7. The shovel as claimed in claim 5, wherein the processing circuitry is configured not to activate the display in response to first switching of the switch after a transition from a key-on state to a key-off state.

8. The shovel as claimed in claim 5, wherein the processing circuitry is configured not to activate the display before passage of a predetermined second time since a transition from a key-on state to a key-off state.

9. The shovel as claimed in claim 1, wherein the processing circuitry is configured to display a non-operation state screen on the display in response to the switching of the switch, the non-operation state screen being different from an operation state screen displayed on the display in a key-on state.

10. The shovel as claimed in claim 9, wherein a character shown in the non-operation state screen is, larger than a character shown in the operation state screen.

11. The shovel as claimed in claim 9, a display position of predetermined information in the non-operation state screen is different from a display position of the predetermined information in the operation state screen.

12. The shovel as claimed in claim 9, wherein a number of items of information displayed in the non-operation state screen is smaller than a number of items of information displayed in the operation state screen.

13. The shovel as claimed in claim 9, wherein a number of colors used in the non-operation state screen is smaller than a number of colors used in, the operation state screen.

14. The shovel as claimed in claim 1, wherein the processing circuitry is configured to output the information stored in the shovel in response to the switching of the switch during stoppage of an engine.

15. The shovel as claimed in claim 1, wherein the processing circuitry is configured to output the information stored in the shovel in such a manner as to enable a person outside the door to perceive the information, in response to the switching of the switch.

16. The shovel as claimed in claim 1, wherein the processing circuitry is configured to hold the display deactivated until the switching of the switch.

17. A system for a shovel, the shovel including a lower traveling structure, an upper swing structure swingably mounted on the lower traveling structure, a cab mounted on the upper swing structure, a door provided on the cab, a display placed in the cab, and a switch placed at a position near the door and distant from the display, the system comprising:

processing circuitry configured to output information stored in the shovel in response to switching of the switch, the information including information on maintenance of the shovel.

18. The shovel as claimed in claim 1, wherein the processing circuitry is configured to cause electric power to be supplied to the display in response to the switching of the switch in a key-off state.

19. The shovel as claimed in claim 1, wherein the processing circuitry is configured to output the information in response to the switching of the switch, so as to enable a maintenance worker to view the information by opening the door provided on the cab without riding in the cab.

20. A shovel comprising:

a lower traveling structure;

an upper swing structure swingably mounted on the lower traveling structure;

a cab mounted on the upper swing structure;

a door provided on the cab;

a display placed in the cab;

a switch placed at a position near the door and distant from the display; and processing circuitry configured to output information stored in the shovel in response to switching of the switch, wherein an amount of the output information is smaller than an amount of information of an operation state screen that is displayed while the shovel is in operation.

* * * * *